United States Patent [19]

Fast

[11] Patent Number: 4,694,595

[45] Date of Patent: Sep. 22, 1987

[54] PRODUCT INFORMATION DISPLAY TAG

[76] Inventor: Jacob Fast, 7561 NW. 9th St., Plantation, Fla. 33317

[21] Appl. No.: 876,166

[22] Filed: Jun. 19, 1986

[51] Int. Cl.[4] ..... A47F 7/00

[52] U.S. Cl. ..... 40/19.5; 40/20 R; 40/124.4; 211/57.1; 211/59.1; 211/54.1

[58] Field of Search ..... 40/19.5, 20, 124.1, 40/124.4, 613; 211/59.2, 57.1, 54.1

[56] References Cited

U.S. PATENT DOCUMENTS

| | | | |
|---|---|---|---|
| 2,202,178 | 5/1940 | Welles | 40/613 |
| 3,189,185 | 3/1965 | Grasso . | |
| 3,483,995 | 2/1969 | Larson . | |
| 3,912,084 | 8/1975 | Valiulis . | |
| 4,066,169 | 1/1978 | Hochman | 211/57.1 |
| 4,463,510 | 8/1984 | Windish | 40/19.5 |
| 4,525,944 | 7/1985 | Fast . | |
| 4,531,313 | 7/1985 | Fast | 40/20 R |
| 4,583,308 | 4/1986 | Taub | 40/19.5 |
| 4,646,454 | 3/1987 | Fast | 40/124.1 |

*Primary Examiner*—Henry E. Raduazo
*Attorney, Agent, or Firm*—Holman & Stern

[57] ABSTRACT

An elongate product information and display tag of plastic sheet is disclosed for use in association with a skyhook structure having a vertical limb extending upwardly from a mounting bracket secured to a perforated board and a horizontal limb extending forwardly from a hump-like bend which joins the limbs. The information and display tag has a mounting portion particularly designed for securing the tag on the hook structure at the hump-like bend, an elongate portion for extending over the horizontal limb of the structure and a product information and display portion at the distal end of the elongate portion for displaying product information forwardly of the horizontal limb. The mounting portion has an inboard section with apertures connected by an axial slit which is pressed down over the hump-like bend, and an outboard section which is bent down behind the hump-like bend and into engagement with the vertical limb of the hook structure by means of a further axial slit and aperture in the outboard section.

11 Claims, 4 Drawing Figures

PRODUCT INFORMATION DISPLAY TAG

BACKGROUND OF THE INVENTION

This invention relates to product identification and information display tags for merchandise suspended from horizontally extending support hooks and the like. More particularly, the invention relates to such tags which are easily attached to and removed from support hooks without being subject to inadvertent removal, and which display product information forwardly of the supported merchandise.

I have, in recent years developed a range of product display tags of the above type for use with different types of support hooks, the tags in general being formed from plastic sheet so as to provide a mounting portion which attaches to a support hook at the back or proximal end of the hook, and an elongate portion which extends forwardly over the support hook (and the products suspended thereon) for presenting product information at the forward or distal end of the support hook. The product information may, for example, be provided on a label secured to a downwardly depending display portion of the tag located forwardly with respect to the distal end of the support hook so that the product information is conveniently displayed to a consumer or the like at a location forwardly of the merchandise. With display tags of this nature, when a product is to be removed from the support hook, the tag may be flexed upwardly and may fall back into position after the product has been released from the hook.

For example, in my prior U.S. Pat. No. 4,525,944, there are disclosed a variety of product display tags having specifically designed mounting portions particularly adapted for securing the tags to forms of support hook structures that attach to perforated boards as commonly used in supermarkets and like stores for displaying suspended products in the form of blister packs and the like. The hook structures referred to in the patent generally comprise individual hooks formed from metal rod and each of which has a support bracket formation at its proximal end whereby the hook is attached to a perforated board individually. The respective display tags have mounting portions designed particularly to be attached to the support bracket formations of the respective hook structures.

Further, in my copending application Ser. No. 792,604 filed Oct. 29, 1985, there is disclosed a form of display tag particularly adapted for use on wire hooks which form part of an integrated, free-standing display unit wherein a hook is attached at its back end to a transverse metal rod. Also, in my copending application Ser. No 835,941 filed Mar. 4, 1986, there is disclosed a form of display tag particularly adapted for use with a "gangbar" type hook structure comprising plural support hooks extending from a common gangbar attached to a perforated board. The disclosures of these patent applications are specifically incorporated herein by reference.

One form of support structure for use in displaying a product at an elevated level above a perforated board on which the hook is mounted, and which is not specifically referred to in the above-noted patents or applications, is a so called "sky hook" stucture which comprises a vertical limb extending upwardly from a mounting bracket secured to the board, and a horizontal limb forming the support hook itself extending from a hump-like bend at the top of the vertical limb.

It is an object of the present invention to provide a product display tag of the general character previously described which is particularly adapted for mounting on a sky hook structure although not necessarily limited in its application to this purpose.

SUMMARY OF THE INVENTION

The invention provides a product information display tag blank for the purpose described comprising an elongate element of plastic sheet which has a mounting portion particularly configured for attachment to the hump-like bend between the vertical and horizontal limbs of a skyhook-type product display hook so as to securely mount the tag on the hook structure with an elongate portion of the tag extending over the horizontal limb of the hook to present product information at its forward end. Thus, in accordance with the invention, the mounting portion of the tag has an inboard section adjacent the elongate portion and an outboard section separated from the inboard section by a transverse fold line, the outboard portion extending to a proximal end of the tag, a pair of axially disposed longitudinally spaced apertures connected by an axial slit formed in the inboard section, and a further axially disposed aperture formed in the outboard section, the outboard section further including another axial slit extending into the further aperture from the proximal end of the tag.

In use, with the elongate portion of the tag extending over the horizontal limb of the skyhook, the horizontally spaced apertures in the inboard section of the tag can, due to the presence of the axial slit connecting the apertures, be pushed down over the hump-like bend connecting the vertical and horizontal limbs of the hook, and provide a tight friction fit of the tag on the hump-like bend. (It is understood that the size of the apertures is related to the diameter of the hook material.) Then, the outboard section of the tag can be folded down behind the hook about the transverse bend line, and the further aperture worked into engagement around the vertical limb of the hook through the further slit. It is found that this construction of mounting portion provides a secure, stable, yet releasable and reusable mounting arrangement for a tag on a skyhook structure.

The elongate portion as well as the mounting portion of the tag may be provided with longitudinally extending ribs, creases, or corrugations for reinforcing the tag, as fully disclosed in my copending application entitled "Longitudinally Reinforced Display Tag For Product Information" filed concurrently herewith, and the contents of which is expressly incorporated herein by reference. The longitudinal reinforcement of the tag enables, inter alia, its width to be decreased thereby saving on material and/or providing decreased surface area for dust collection.

At its forward or distal end, the tag may be provided with an intergral information display element which in use, is folded downwardly beyond the distal end of the product support hook. Alternatively, the display portion may be an attachable/detachable discreet entity as disclosed, for example, in my copending application Ser. No. 719,116 filed Apr. 12, 1985 the contents of which is also expressly incorporated herein by reference.

Additional features and advantages of the invention will be apparent from the ensuing description and claims read in conjunction with the accompanying drawings.

DESCRIPTION OF PREFERRED EMBODIMENT

Figures 1, 2, 3, 4:
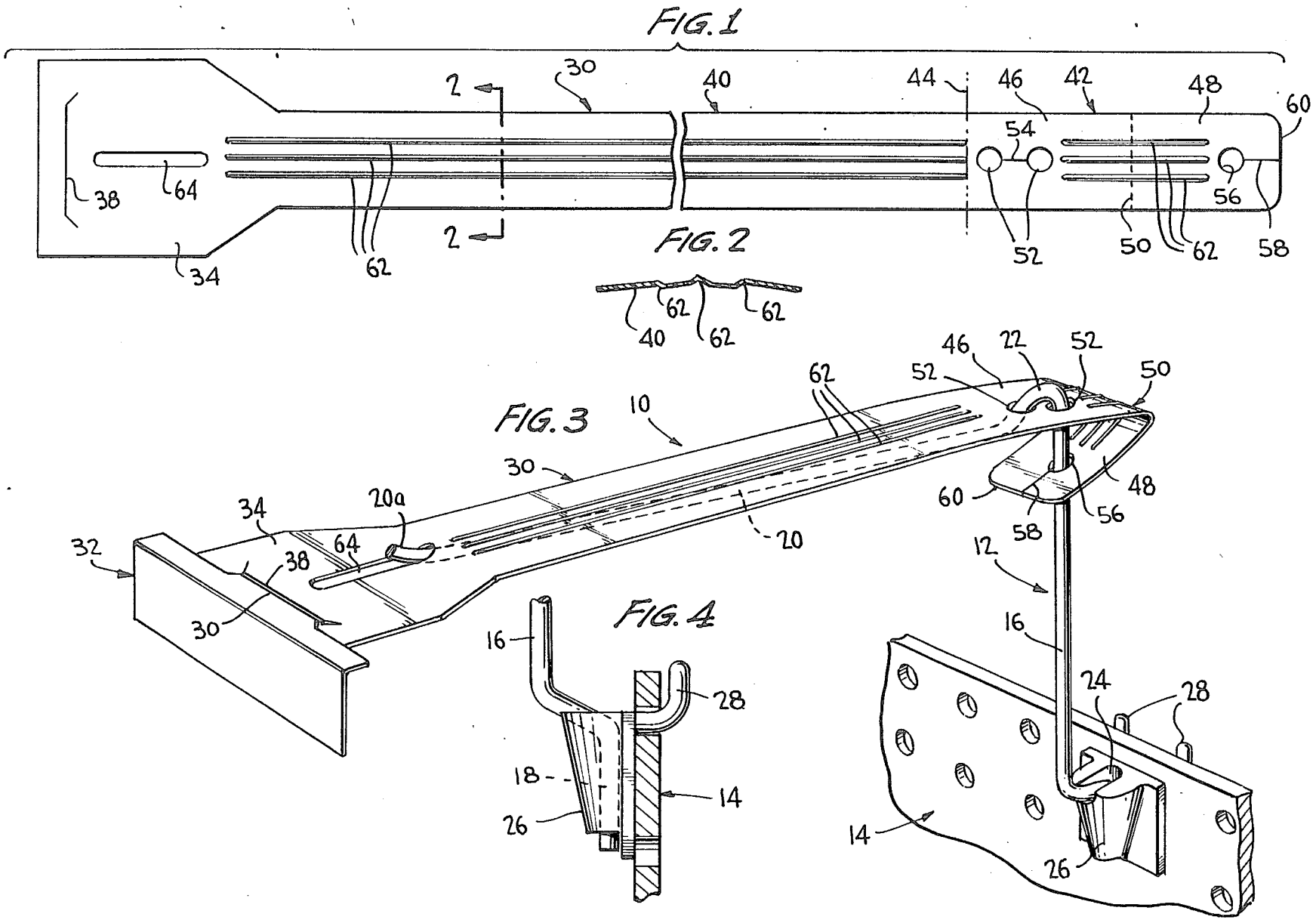
FIG. 1 is a plan view of a blank for a product information display tag in accordance with the invention.
FIG. 2 is an enlarged sectional view on line 2—2 of FIG. 1.
FIG. 3 is a perspective view showing a complete tag mounted on a skyhook stucture.
FIG. 4 is an enlarged elevational view of a mounting bracket for the skyhook structure with a perforated board on which it is mounted being shown in section.

A product information and display tag blank 10 which is made of a die cut plastic sheet well known for tags of this type, is specifically designed for use on a skyhook structure 12 as shown in FIG. 3, the skyhook structure being supported on a perforated board 14, for the purpose of displaying products in a suspended array at and elevated location above the level of the board. The skyhook has a vertical limb 16 with a cranked lower end 18, and horizontal limb 20 forming a display hook on which the products may be suspended in a row. The vertical and horizontal limbs are connected by a hump-like bend 22. Distal end **20*a* of the horizontal limb may be slightly upwardly bent. Lower end 18 of the hook is received in a pocket 24 formed in a plastic bracket 26 having a rearwardly projecting pair of prongs 28 which attached the bracket and hook to board 14** by insertion through a pair of adjacent board perforations. The hook and bracket are standard items and not claimed herein per se.

Tag 10 may be formed by an elongate plastic blank 30 (FIG. 1) and an attachable/detachable information display element 32 releasably attached to a forward or distal end portion 34 of the blank by means of a tongue 36 on element 32 received in a transverse slit 38 in portion 34 in a manner fully explained in the above noted patent application Ser. No. 719,116. Alternatively, blank 30 may have an integrally formed information display portion (not shown).

Rearwardly of end portion 34, blank 30 has a reduced-width elongate body portion 40, and a mounting portion 42. The body portion and mounting portion are separated by an imaginary transverse line 44. The mounting portion has an inboard section 46 and an outboard section 48, the respective sections being separated by a transverse fold line 50. The inboard section 46 is formed with a pair of axially spaced apertures 52 connected by an axial slit 54, the diameter of the apertures substantially conforming to the diameter of hook 12. Outboard section 48 has a similar axially located aperture 56 and an axial slit 58 extending from proximal end 60 of the blank into aperture 56.

The body portion 40 and mounting portion 42 of the blank can be narrower than end portions 34 because they are longitudinally reinforced by strenthening ribs or creases 62 as explained more fully in the above noted copending patent application filed concurrently herewith. The ribs may give a slight bow (as evident in FIG. 2) to these portions of the tag and serve to provide lengthwise stablization and reinforcement. Forward portion 34 of the blank is provided with an elongate slot 64 for hook end 20a to extend through in known manner.

In order to attach the tag to the hook, apertures 52 and connecting slit 54 are pressed down onto the hump-like bend 22 so as to tightly and resiliently grip the hook by friction. Section 48 is then bent down behind the hook and aperture 56 is worked into engagement around vertical limb 16 through the slit 58 as shown in FIG. 3. This mounting arrangement provides a tight and stable form of attachement of the tag on the hook while allowing the tag readily to be removed and reused.

While only a single preferred embodiment of the invention has been described herein in detail, the invention is not limited thereby and modifications can be made within the scope of the attached claims.

What is claimed is:

1. An elongate product information and display tag blank of plastic sheet comprising an elongate portion and an adjacent mounting portion particularly adapted for securing the blank on a skyhook structure having vertical and horizontal limbs joining at a hump-like bend between the vertical and the horizontal limbs of the structure, the mounting portion having an inboard section adjacent the elongate portion, an outboard section connected to the inboard section by a transverse bend line and a proximal end, the outboard section extending from the bend line to the proximal end of the blank, a pair of axially located longitudinally spaced apertures formed in the inboard section, a first axial slit connecting the apertures, a further axially located aperture in the outboard section, and a second axial slit extending from the proximal end into said further aperture.

2. The invention as defined in claim 1 wherein the elongate portion is provided with lengthwise reinforcement ribbing.

3. The invention as defined in claim 2 wherein the mounting portion is provided with lengthwise reinforcement ribbing extending across said bend line between said pair of apertures and said further aperture.

4. The invention as defined in claim 2 wherein the blank includes an enlarged-width forward end portion extending from a distal end of the elongate portion.

5. The invention as defined in claim 4 wherein the forward end portion includes attachment means for a separate information and display tag element.

6. In combination with a skyhook structure having a vertically extending limb, a horizontally extending limb forming a product display hook, and a hump-like bend connecting the limbs, an elongate product information and display tag of plastic sheet having an elongate portion extending over the horizontal limb of the hook, a product information and display portion extending from the elongate portion forwardly of the horizontal limb, and a mounting portion extending rearwardly of the elongate portion for securing the tag on the hook structure, the mounting portion including an inboard section with aperture means formed therein tightly embracing the hump-like bend, and an outboard section extending rearwardly from the inboard section, the outboard section being folded downwardly behind the hook structure and having further aperture means formed therein embracing the vertically extending limb of the skyhook structure.

7. The invention as defined in claim 6 wherein the aperture means comprises a pair of axially located longitudinally spaced apertures connected by an axial slit, and wherein the further aperture means comprises a further axially located aperture and a further axial slit extending from a proximal end of the tag into the further aperture.

8. The invention as defined in claim 6 wherein the product information and display portion comprises a detachable element releasably secured on the elongate portion.

9. The invention as defined in claim 6 wherein the elongate portion of the tag includes lengthwise extending reinforcement ribbing.

10. The invention of claim 9 wherein the elongate portion has an enlarged-width distal end section absent said ribbing.

11. The invention as defined in claim 10 wherein said information and display portion has a releasable connection with said distal end section.

* * * * *